US006311458B2

(12) United States Patent
Tharpe, Jr.

(10) Patent No.: US 6,311,458 B2
(45) Date of Patent: Nov. 6, 2001

(54) APPARATUS FOR PRODUCING SHOCK ABSORBING PADS AND ASSOCIATED METHODS

(76) Inventor: John M. Tharpe, Jr., 1005 Willie Pitts Jr., Rd., P.O. Box 3970, Albany, GA (US) 31706

( * ) Notice: Subject to any disclaimer, the term of this patent is extended or adjusted under 35 U.S.C. 154(b) by 0 days.

(21) Appl. No.: 09/201,950

(22) Filed: Dec. 1, 1998

(51) Int. Cl.[7] ..... B65B 9/02; B65B 63/00

(52) U.S. Cl. ..... 53/115; 53/122; 53/521; 53/528; 53/553

(58) Field of Search ..... 493/464, 967; 53/115, 122, 139.5, 450, 472, 550, 553, 521, 524, 526, 528

(56) References Cited

U.S. PATENT DOCUMENTS

| | | | | |
|---|---|---|---|---|
| 1,573,599 | * | 2/1926 | Elliott | 53/521 X |
| 2,119,982 | * | 6/1938 | Blosser et al. | 53/521 X |
| 2,121,454 | * | 6/1938 | Teall | 53/521 X |
| 2,391,814 | * | 12/1945 | Woodall | 53/521 X |
| 2,610,134 | * | 9/1952 | Hoblick | 53/553 X |
| 2,907,447 | * | 10/1959 | Offutt et al. | 53/526 X |
| 3,020,687 | * | 2/1962 | Joa | 53/521 X |
| 3,201,295 | * | 8/1965 | DeWoskin | 53/521 X |
| 3,206,345 | * | 9/1965 | Stickel | 53/528 X |
| 3,526,078 | * | 9/1970 | Dye | 53/526 |
| 3,606,726 | * | 9/1971 | Spertus et al. | 53/553 X |
| 4,089,149 | * | 5/1978 | Evans | 53/436 |
| 5,328,568 | * | 7/1994 | Pregont | 162/226 |

* cited by examiner

*Primary Examiner*—John Sipos
(74) *Attorney, Agent, or Firm*—Allen, Dyer, Doppelt, Milbrath & Gilchrist, P.A.

(57) ABSTRACT

An apparatus and associated methods are provided for producing a plurality of shock absorbing pads. The apparatus preferably has a core pad former for forming particulate core material into a plurality of individual core pads, a core pad encaser positioned downstream from the core pad former for encasing the plurality of individual core pads with a selected sheet of material to thereby form a sheet of a plurality of shock absorbing pads, a pad sheet debulking conveyor positioned adjacent the core pad encaser for debulking the sheet of the plurality of shock absorbing pads and conveying the sheet of the plurality of shock absorbing pads downstream, and a pad separator positioned downstream the pad sheet conveyor for separating the sheet into a plurality of individual shock absorbing pads.

29 Claims, 9 Drawing Sheets

TOP PAPER FEED
BOTTOM PAPER FEED 60
62
63
65
66
75
76
77
78
79
90
92
93
94
95

APPARATUS FOR PRODUCING SHOCK ABSORBING PADS AND ASSOCIATED METHODS

FIELD OF THE INVENTION

The invention relates to the packaging industry, and, more particularly, to the field of packaging products which can easily be damaged during packing procedures or during shipments.

BACKGROUND OF THE INVENTION

Over the years various packaging has been used in association with the shipments of products which can be damaged during the packaging and shipment processes. One of these products, for example, has been fresh produce, such as apples, pears, peaches, oranges, and grapefruits, which can be easily bruised, smashed, or inflicted with other types of damaged by the packing and shipping processes. With such fragile items as fresh produce, the requirements of carefully packing and handling can slow down the production process considerably.

Various shock absorbing packaging techniques have been used for fresh produce such as packing the produce in foam boxes or foam wrap, adding plastic bubble-wrap to a box or package, and adding a large number of foam particles or chunks of foam to a box or package after the produce has been placed in the box. These prior techniques, however, have numerous drawbacks. For example, foam and plastic do not have very good environmentally friendly traits, e.g., often not readily recyclable. Also, some of these techniques can slow down the packaging process. Further, using the chunks of foam, for example, can be messy for both the company packing the produce and for the person or company receiving the produce when the produce is unpacked.

SUMMARY OF THE INVENTION

In view of the foregoing background, the present invention advantageously provides an apparatus and methods for producing shock absorbing pads at a relatively high speed for use in readily packing products which can be damaged in the packing and shipping processes. The present invention also advantageously provides an apparatus and methods for producing shock absorbing pads which allow easy packing of products during a packing process. The present invention additionally provides an apparatus and methods for producing shock absorbing pads which are relatively inexpensive and are environmentally friendly. The present invention further provides an apparatus and methods for producing shock absorbing pads which can utilize existing stock, waste product, or other debris from a packing company, as well as various types of debris, to form core or core material for each pad.

More particularly, the apparatus preferably includes a core pad former for forming particulate core material into a plurality of individual core pads, a core pad encaser positioned downstream from the core pad former for encasing the plurality of individual core pads with a selected sheet of material to thereby form a sheet of a plurality of shock absorbing pads, pad sheet debulking and conveying means positioned adjacent the core pad encaser for debulking the sheet of the plurality of shock absorbing pads and conveying the sheet of the plurality of shock absorbing pads downstream, and a pad separator positioned downstream the pad sheet conveyor for separating the sheet into a plurality of individual shock absorbing pads.

The core pad former which forms a plurality of cores preferably forms the cores from particulate core material, e.g., paper. The core pad former preferably includes a mounting frame, an annular drum frame rotatingly mounted to the mounting frame, and a plurality of core pad forming frames mounted to outer peripheries of the drum frame so that when the drum frame rotates core material is collected on each of the plurality of core pad forming frames.

The pad sheet debulking and conveying means is preferably provided by a pair of spaced-apart conveyors positioned in non-parallel planes with respect to each other so that a distance between the spaced-apart conveyors is greater at a first end which receives the plurality of products than at a second end which outputs the plurality of products and so that the pair of conveyors converge toward each other at the second end to thereby debulk the plurality of products as the products conveyingly travel between the conveyors and between the first and second ends thereof.

The pad separator of the present invention, for example, can advantageously be provided by a roller having a roller body which includes first and second ends and an outer surface when extends substantially circumferentially around outer peripheries of the roller body between the first and second ends. A blade, e.g., a cutting or knife blade, is preferably mounted to the roller so that the plane of the lateral extent of the blade is generally perpendicular to the outer surface of the roller and the entire lengthwise extent of the blade of the is in a position non-perpendicular to respective planes of the first and second ends of the roller body so as to be skewed between the first and second ends thereof and whereby the combination of the blade and roller define a rotating knife which during rotation thereof cuttingly separates a sheet of products into a plurality of individual products.

The present invention also advantageously provides a method of forming a plurality of shock absorbing pads. The preferably includes the steps of forming core material into a plurality of individual core pads, encasing the plurality of individual core pads with a selected sheet of material to thereby form a sheet of a plurality of shock absorbing pads, debulking the sheet of the plurality of shock absorbing pads, and separating the sheet into a plurality of individual shock absorbing pads.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and single, double, and triple prime notation, where used, indicate similar elements in alternative embodiments.

Figure 1:
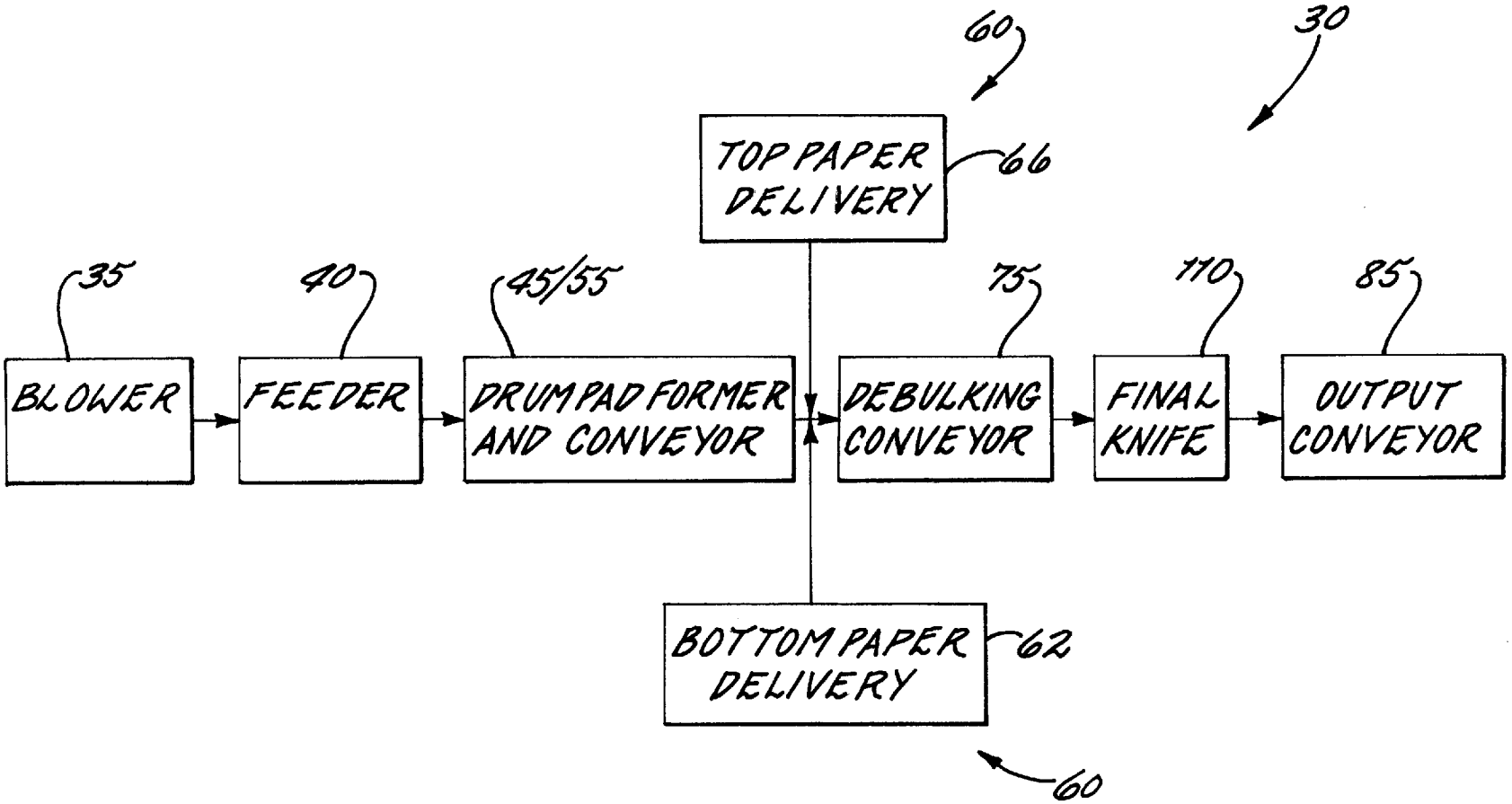
FIG. 1 is a schematic diagram of an apparatus for producing shock absorbing pads according to the present invention.
Figure 2:
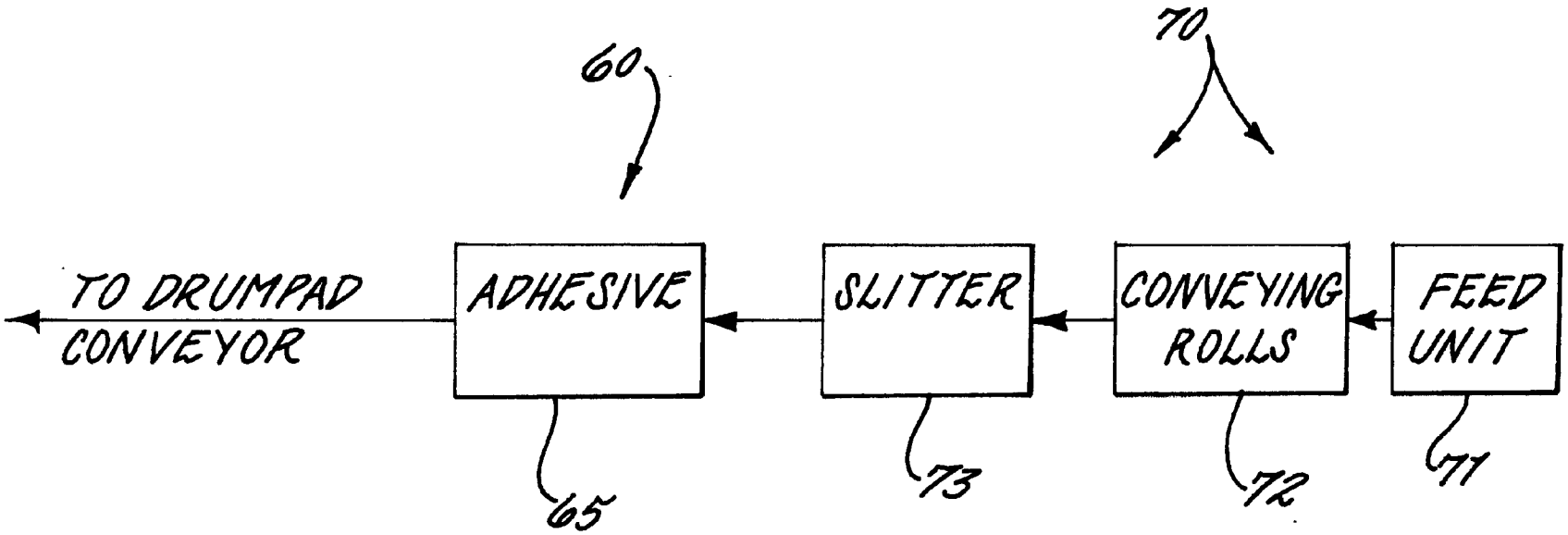
FIG. 2 is a schematic diagram of an embodiment of a material feed portion of an apparatus for producing shock absorbing pads according to the present invention.
Figure 3:
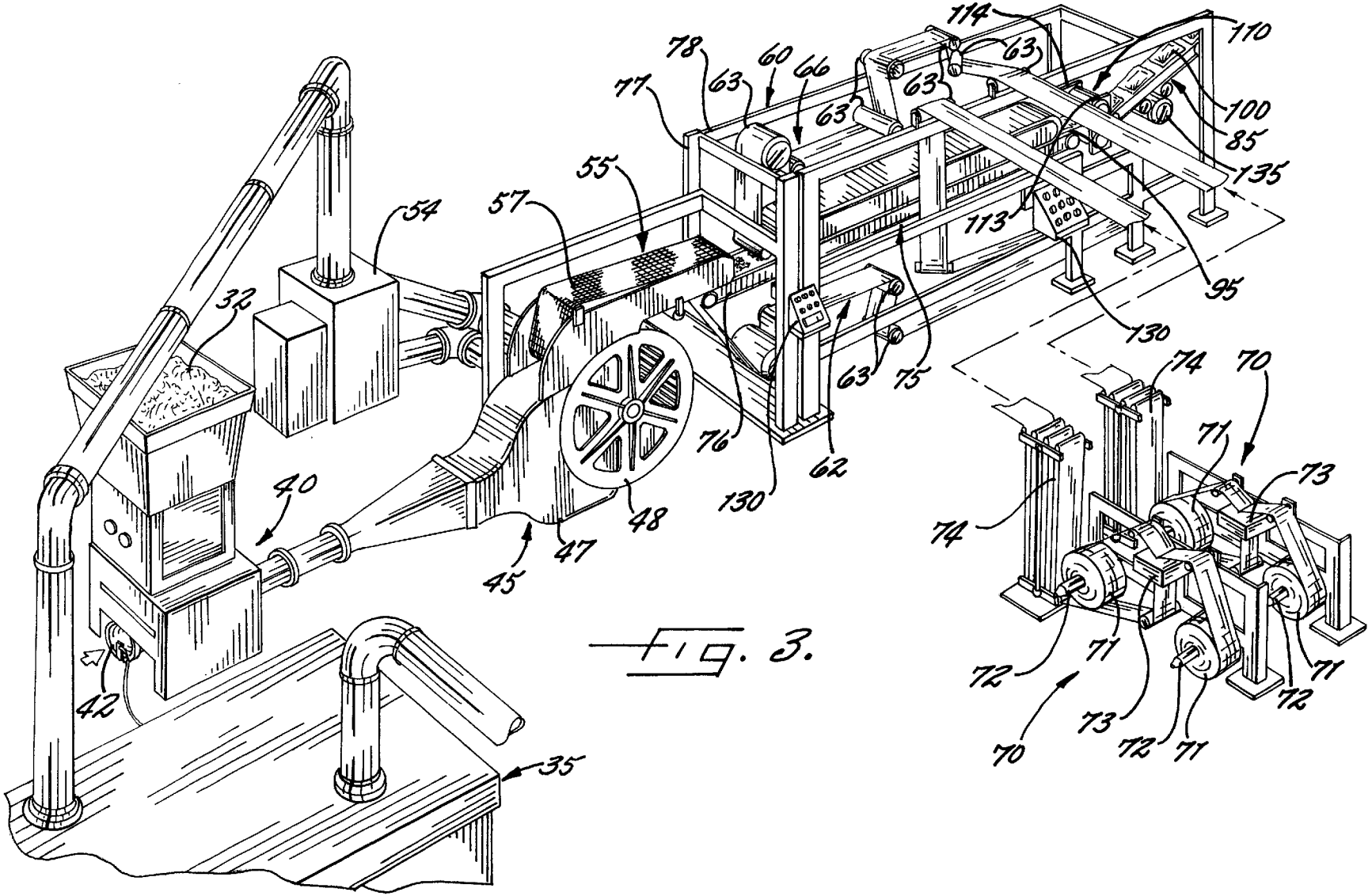
FIG. 3 is a perspective view of an apparatus for producing shock absorbing pads according to the present invention.

FIGS. 1–3 illustrate an apparatus 30 for producing a plurality of shock absorbing pads 100 preferably at a relatively high speed in a high quantity process. As schematically illustrated in FIG. 1, the apparatus 30 preferably includes a blower 35 positioned to blow air or other gases through a conduit or pipe upstream to a core material feeder 40. The core material feeder 40 receives large quantities of particulate core material 32, e.g., preferably paper or other product which is either ground, cut, or already in a particulate state for use as described herein, into a chute, bin, or other input thereof. The core material is preferably metered by the feeder 40 and drawn, e.g., by a vacuum like force, into forming pockets or pads 90 by a drum core pad former 45 and/or core pad conveyor 55. The core pad former 45 forms particulate core material into a plurality of individual core pads 90 (see FIGS. 4–6). A core pad conveyor 55 receives the plurality of individual core pads 90, e.g., preferably by a vacuum force transfer or other pressure transfer, and conveys them downstream to a core pad encaser 60 positioned downstream from the core pad former 45 for encasing the plurality of individual core pads 90 with a selected sheet or sheets 92, 94 of material to thereby form a sheet 95 of a plurality of shock absorbing pads 100. The core pad encaser 60 is preferably provided by top and bottom paper deliveries 62, 66 as illustrated and described further herein.

The apparatus 30 also includes a pad sheet debulking and conveying means, e.g., preferably provided by a debulking conveyor 75, positioned adjacent the core pad encaser 60 for debulking the sheet 95 of the plurality of shock absorbing pads 100 and conveying the sheet 95 of the plurality of shock absorbing pads 100 downstream. A pad separator 110, e.g., provided by a final rotating knife, is positioned downstream from the pad sheet debulking conveyor 75 for separating the sheet 95 into a plurality of individual shock absorbing pads 100. An output conveyor 85 is preferably positioned downstream from the pad separator 110 to receive and convey the plurality of individual shock absorbing pads 100 further downstream such as to i a loading container, e.g., boxes, crates, or cartons, which receive the pads 100. The apparatus 30 also preferably has at least one controller 130 positioned to control the speed and/or timing of at least the debulking conveyor 75 and the rotating knife 110. The controller 130, however, preferably also controls the core pad former 45, the core pad conveyor 55, the output conveyor 85, the core pad encaser 60, the core material feeder 40, and the blower 35 as well. As understood by those skilled in the art, the controller 130 is preferably a programmable controller, e.g., including one or more microprocessors operating under stored program control, which can be used to drive a plurality of motors 135, drives, or drive chains associated therewith, and receive a plurality of sensor signals, e.g., optical encoders or other position sensors as understood by those skilled in the art, associated with the apparatus 30 as described and illustrated.

Figure 4:
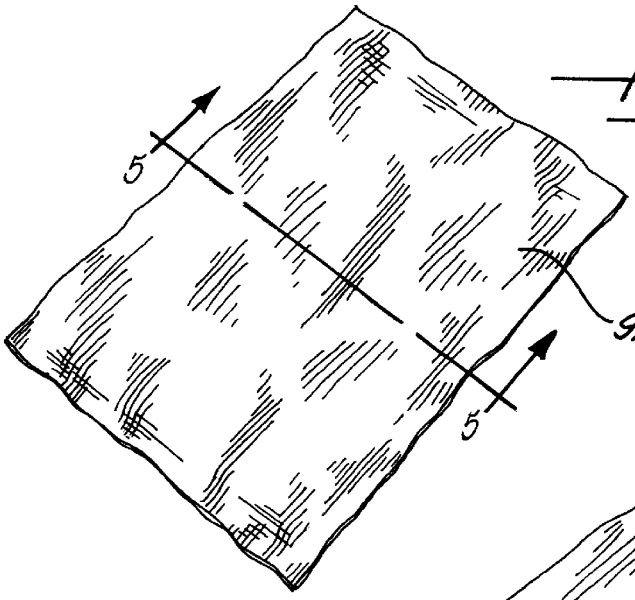
FIG. 4 is a top perspective view of a shock absorbing pad produced by an apparatus for producing shock absorbing pads according to the present invention.
Figure 5:
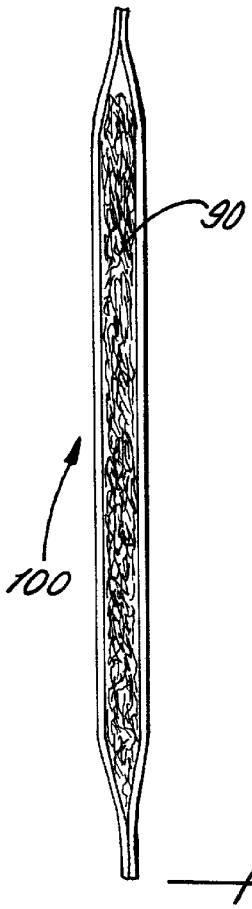
FIG. 5 is a transverse sectional view of a shock absorbing pad taken along line 5—5 of FIG. 4 according to the present invention.
Figure 6:
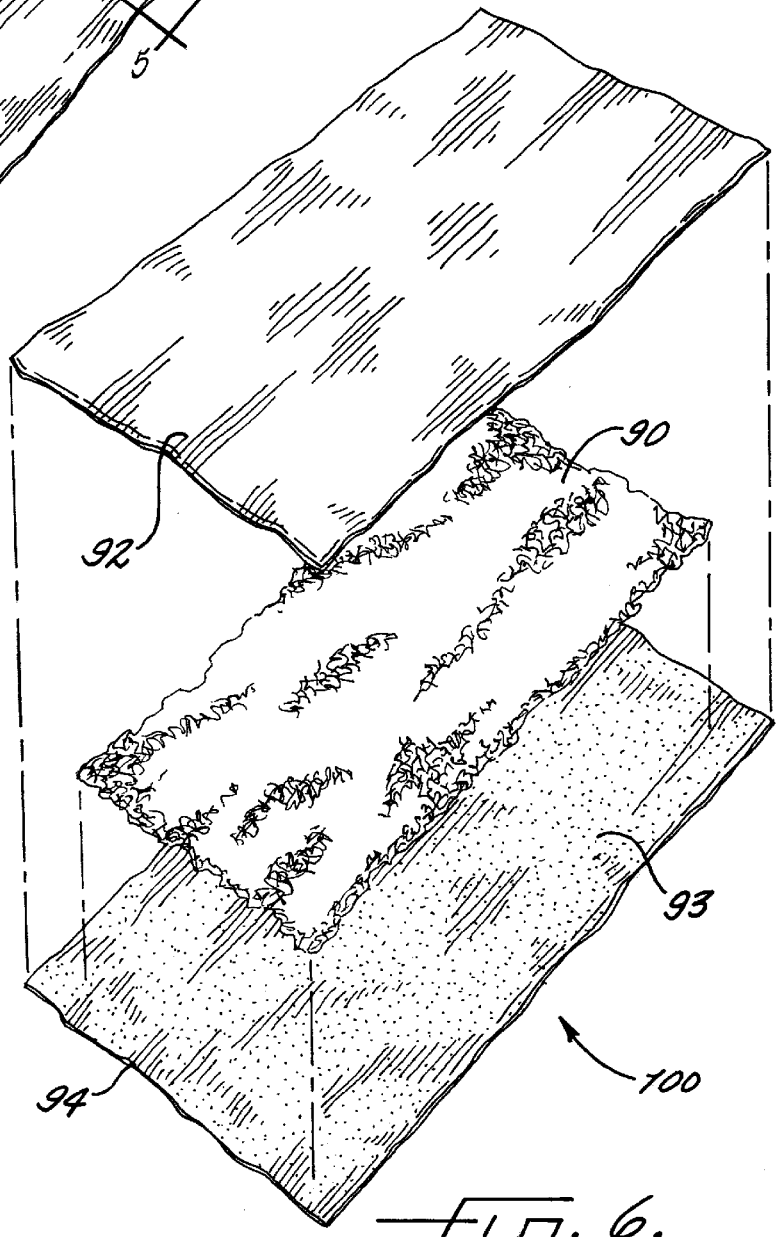
FIG. 6 is an exploded perspective view of a shock absorbing pad produced by an apparatus for producing shock absorbing pads according to the present invention.
Figure 7:
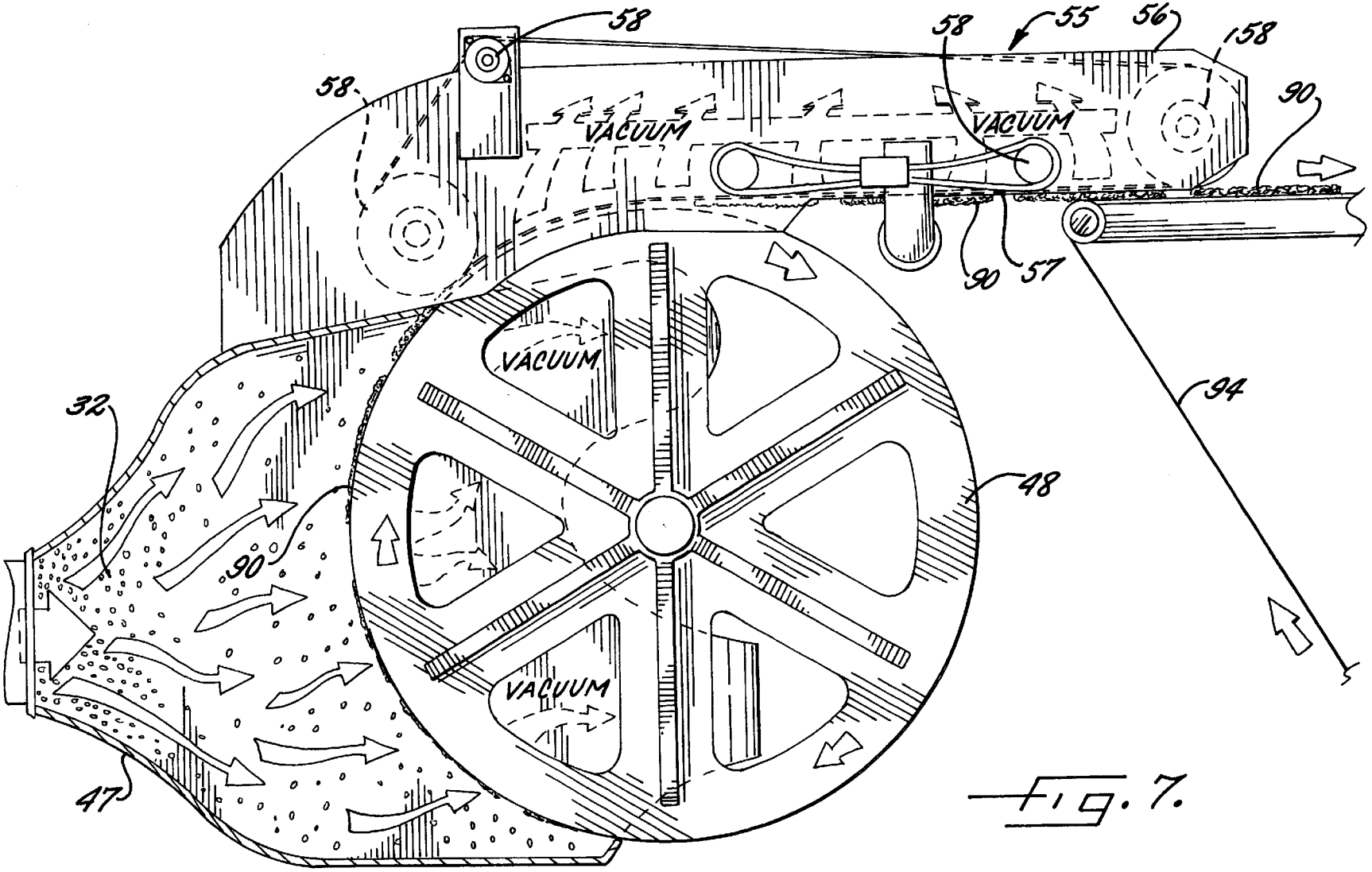
FIG. 7 is a side elevational view a drum pad former and conveyor which form and convey a plurality of cores of a corresponding plurality of shock absorbing pads of an apparatus for producing shock absorbing pads according to the present invention.
Figures 8, 9, 10:
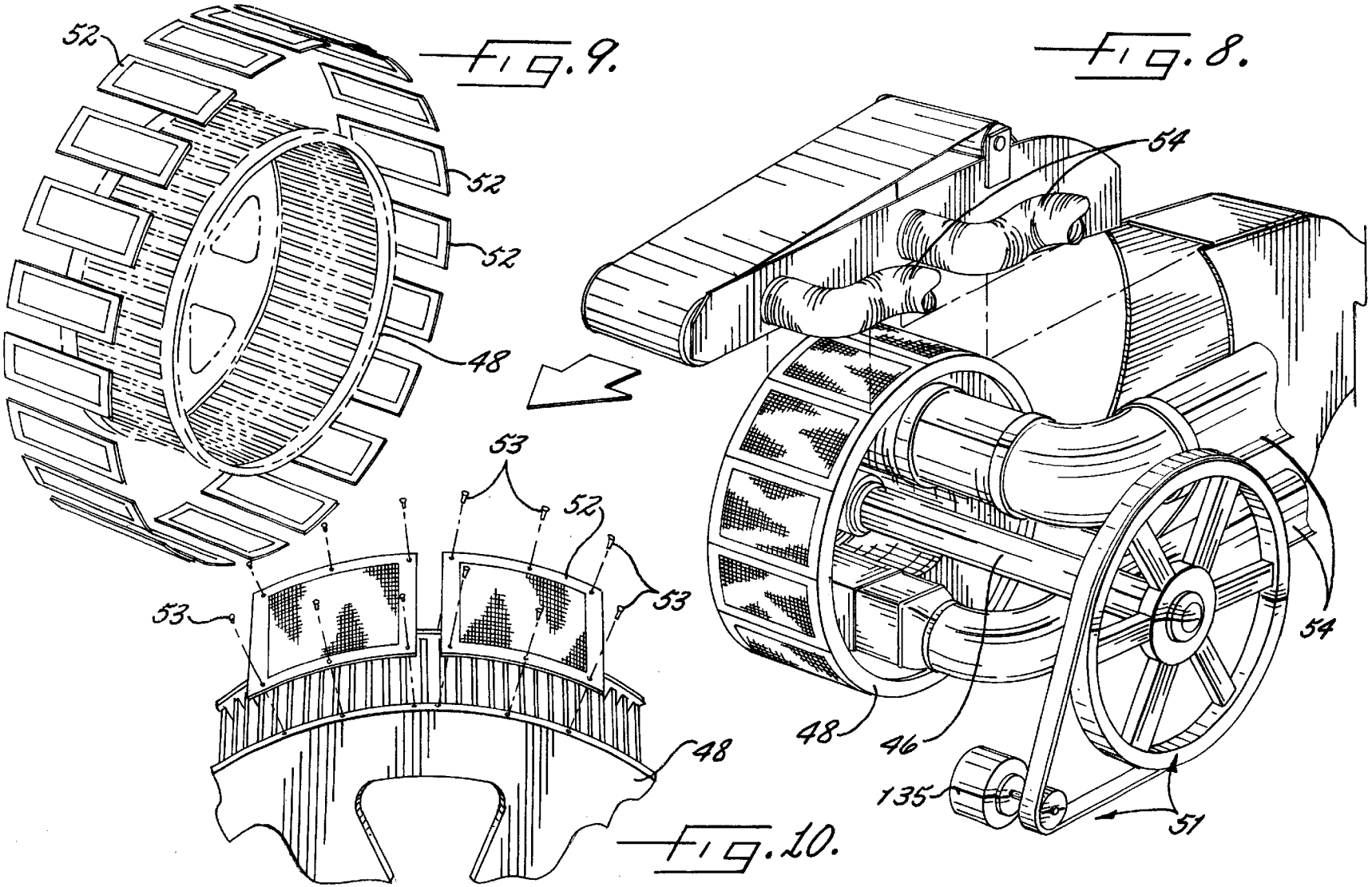
FIG. 8 is a fragmentary perspective view of a drum pad former and conveyor of an apparatus for producing shock absorbing pads according to the present invention.
FIG. 9 is an exploded perspective view of a drum pad former of an apparatus for producing shock absorbing pads according to the present invention.
FIG. 10 is a fragmentary exploded perspective view of a drum pad former of an apparatus for producing shock absorbing pads according to the present invention.
Figures 11, 12, 13:
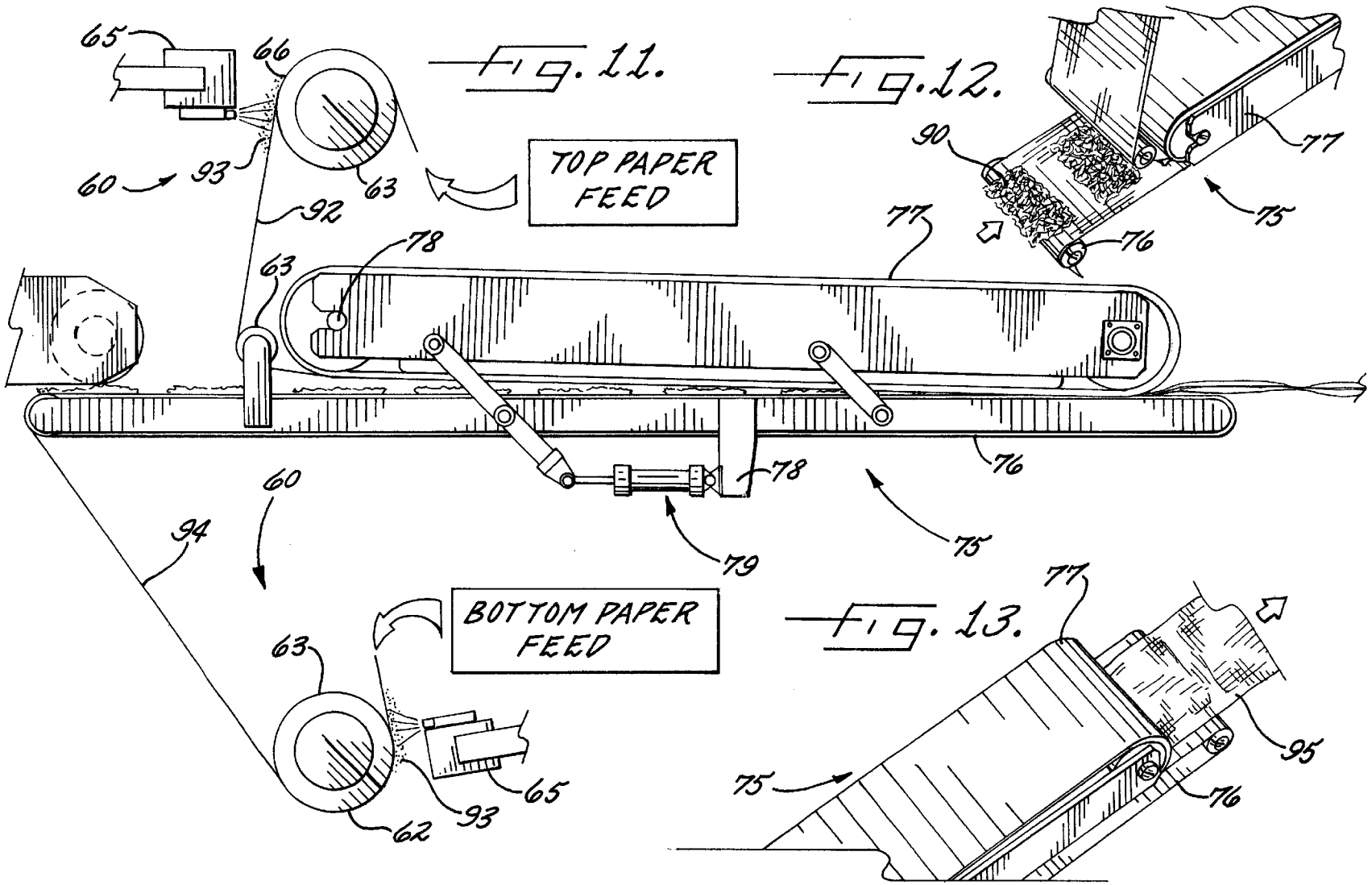
FIG. 11 is a side elevational view of a debulking conveyor of an apparatus for producing shock absorbing pads according to the present invention.
FIG. 12 is a fragmentary perspective view of an input portion of a debulking conveyor of an apparatus for producing shock absorbing pads according to the present invention.
FIG. 13 is a fragmentary perspective view of an output portion of a debulking conveyor of an apparatus for producing shock absorbing pads according to the present invention.
Figure 14:
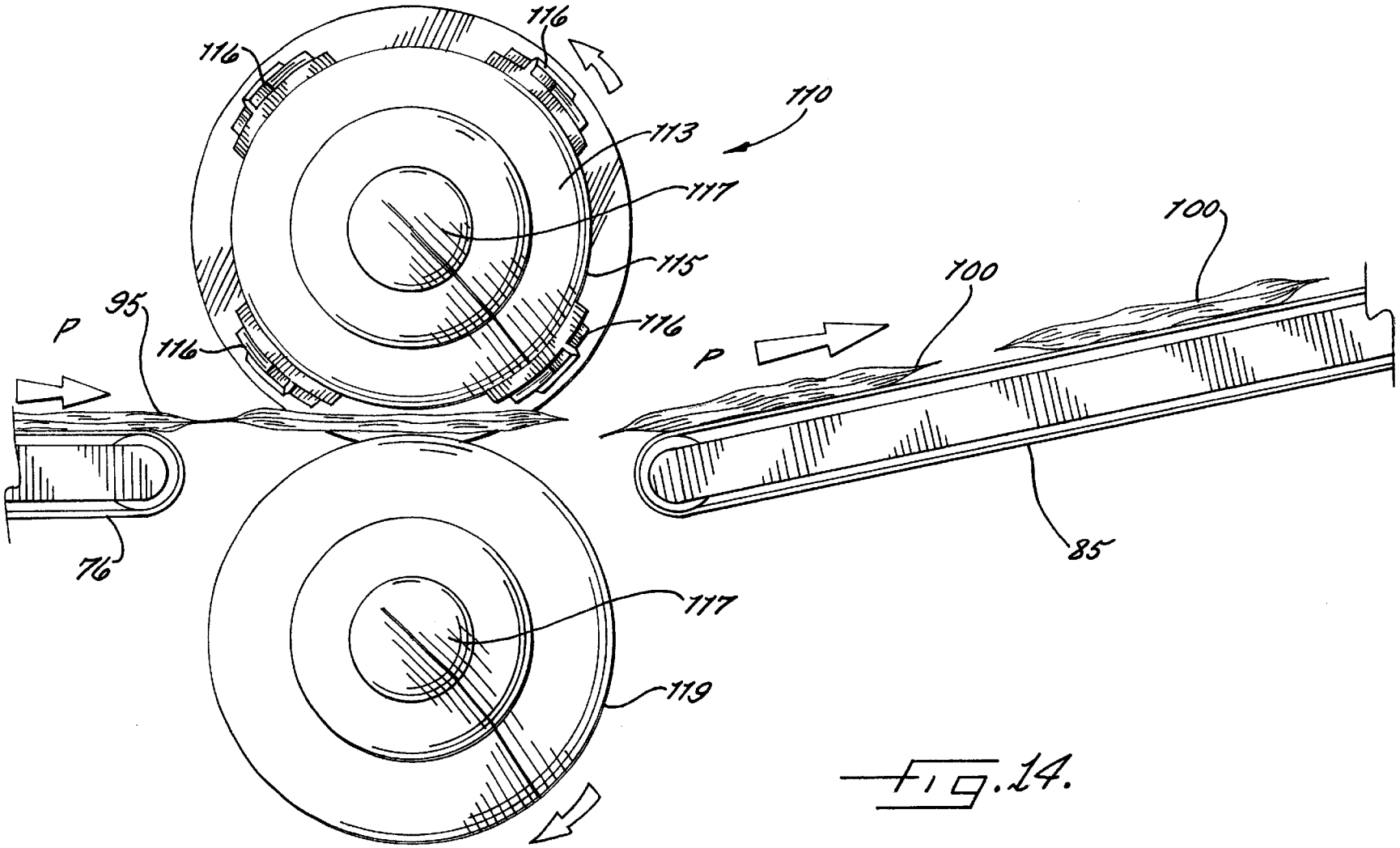
FIG. 14 is a pad separator and conveyor of an apparatus for producing shock absorbing pads according to the present invention.
Figure 15:
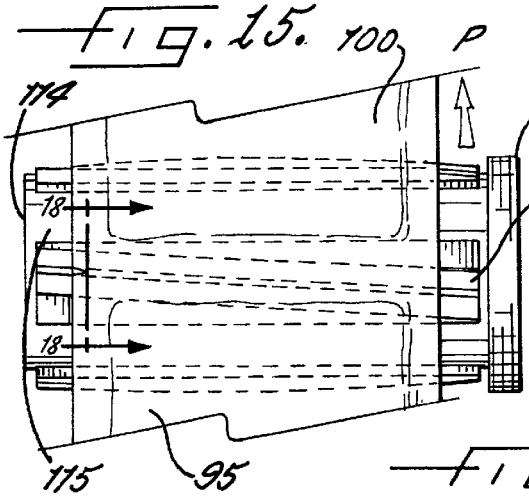
FIG. 15 is a fragmentary bottom view of an initial separating position of a separator which separates a shock absorbing pad from a sheet or web of a plurality of shock absorbing pads of an apparatus for producing shock absorbing pads according to the present invention.
Figure 18:
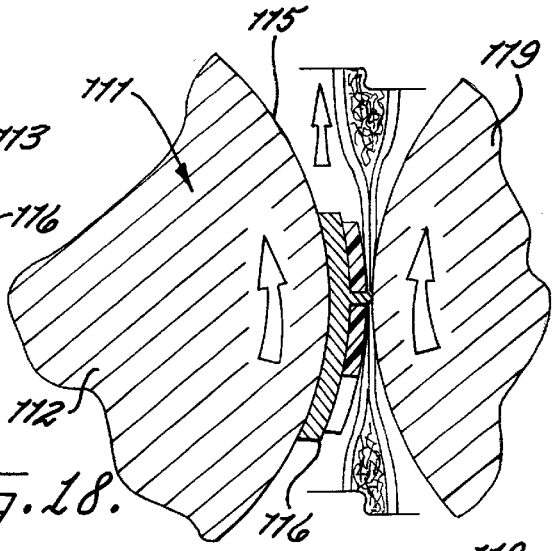
FIG. 18 is a transverse sectional view of a separator taken along line 18-18 of FIG. 15 of an apparatus for producing shock absorbing pads according to the present invention.
Figure 16:
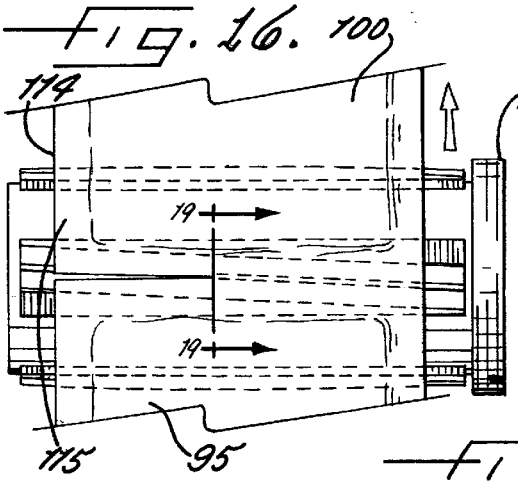
FIG. 16 is a fragmentary bottom view of a partial separating position of a separator which separates a shock absorbing pad from a sheet or web of a plurality of shock absorbing pads of an apparatus for producing shock absorbing pads according to the present invention.
Figure 19:
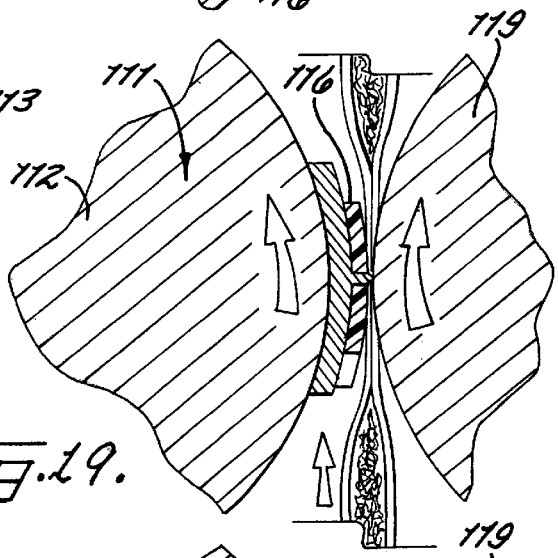
FIG. 19 is a transverse sectional view of a separator taken along line 19—19 of FIG. 16 of an apparatus for producing shock absorbing pads according to the present invention.
Figure 17:
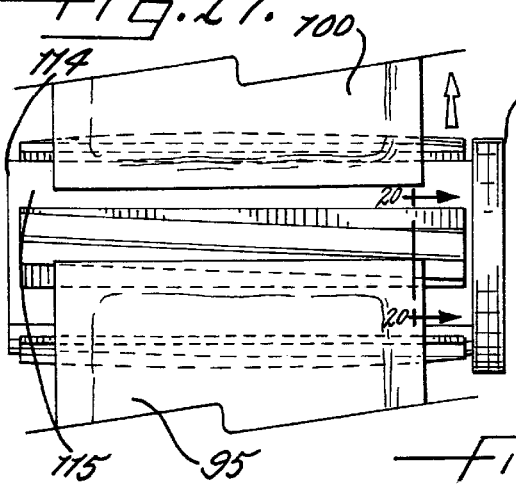
FIG. 17 is a fragmentary bottom view of a fully separating position of a separator which separates a shock absorbing pad from a sheet or web of a plurality of shock absorbing pads of an apparatus for producing shock absorbing pads according to the present invention.
Figure 20:
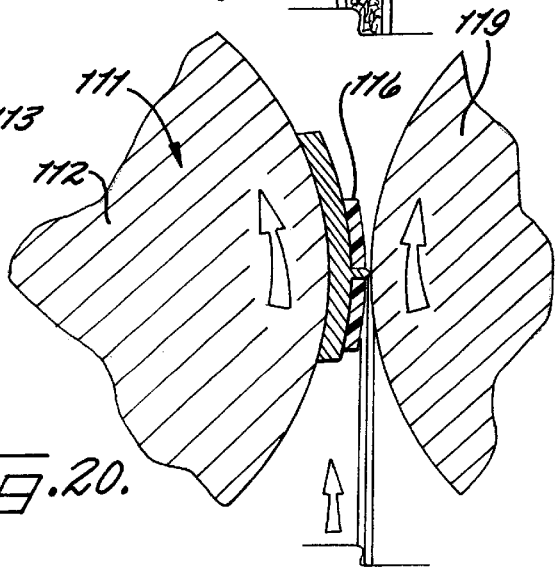
FIG. 20 is a transverse sectional view of a separator taken along line 20—20 of FIG. 17 of an apparatus for producing shock absorbing pads according to the present invention.

More particularly, as perhaps best shown in FIGS. 3 and 7–10, the core pad former 45 which forms a plurality of cores 90 preferably forms the cores 90 from particulate core material 32, e.g., preferably including paper to which water or other moisture can be sprayed or added thereto into an input conduit 42 to inhibit static and provide more fluid control characteristics (see also FIGS. 4–6). In addition to or instead of paper, the particulate core material can also advantageously be by-product or waste from a disposable garment manufacturing plant which would include material such as fluff, super-absorbency material, elastic, polymeric material, glue, and other material related to such processes. This material can be formed by pulverizing or grinding, e.g., using a hammer mill as understood by those skilled in the art, the scrap or waste from a disposable garment manufacturing process and can make good filler for a shock absorbing pad.

The core pad former 45 preferably includes a mounting frame 46, including a drum frame drive 51, an annular drum frame 48 rotatingly mounted to the mounting frame, and a plurality of core pad forming frames 52 mounted to outer peripheries, e.g., by fasteners 53 such as screws or bolts, of the drum frame 48 so that when the drum frame 48 rotates core material is collected on each of the plurality of core pad forming frames 52. A drum frame housing 47 is preferably positioned to house at least portions of the drum frame 48 and receive particulate core material 32 therein from the core material feeder 40 and also receives pressurized air, e.g., a vacuum, therein as well such as from a forming fan or other means for drawing or pulling the core material onto the forming frames 52. The plurality of core pad forming frames 52 preferably each include a screen as shown which can advantageously be sized to a desired core pad size. Also, the number of screens can vary as well depending on the volume desired to be produced, speed, and drum frame size. An air pressure supply 54, e.g., a forming fan or other vacuum assist type force applicator, is also connected to the drum frame housing 47 and the blower 35 and is positioned to draw the core material onto each of the plurality of screens 52 during rotation of the rotating drum frame 48.

The core pad conveyor 55 preferably includes a housing 56, a screen conveying belt 57, and conveyor drive rolls 58. The housing 57 is also preferably connected to the air pressure supply 54 so that the core pads 90 from the screens 52 of the core pad former 50. The pressure supply 55, e.g., vacuum, advantageously provides a lift from the screens 52 to the screen belt 57, e.g., by having a pressure differential.

As perhaps best shown in FIGS. 1–3 and 11–13, the core pad encaser 60 preferably includes a bottom sheet delivery 62 positioned to deliver a continuous sheet of material which forms a bottom or lower sheet 94 underlying the plurality of individual core pads 90 and a top sheet delivery 66 positioned to deliver a continuous sheet of material which forms a top or upper sheet 92 overlying each of the plurality of individual core pads and abuttingly contacting at least portions of the bottom sheet (see FIGS. 4–6). The encasing material is preferably paper, but may also be paper and/or plastic.

The core pad encaser 60 also includes at least a pair of feed rolls, and preferable a plurality of feed rolls 63 as illustrated, positioned to feed the top and bottom sheets 92, 94 of paper so as to encase the plurality of core pads 90. An adhesive applier 65, e.g., one or more glue heads, is also positioned to apply adhesive 93 at least between the top and bottom sheets of paper, e.g., preferably to both the top and bottom sheets 92, 94 as shown in FIG. 6, so that when at least portions of the top and bottom sheets 92, 94 abuttingly contact each other the adhesive 93 sealingly maintains the contact.

As best shown in FIGS. 2–3, the apparatus 30 also includes an encasing material feeder 70 positioned to supply encasing material to the core pad encaser 60 so that the supplied material encases each of the plurality of core pads 90. The encasing material feeder 70 supplies a sheet of top paper 92 to the core pad encaser and a sheet of bottom paper 94 to the core pad encaser 60. The encasing material feeder 70 preferably upper and lower paper feeders which are substantially the same and each includes a feed unit or supply 71, e.g., preferably supplying paper or other material in rolls, and conveying rolls 72 which drivingly convey the material toward the encaser 60. Each feeder can also include a slitter 73 which slits sheets of material into smaller sheets 92, 94 thereof, e.g., for desired sizes of shock absorbing pads 100. Additionally, as understood by those skilled in the art, each feeder advantageously can also include a material tension control unit 74, e.g., a dancer assembly, which controls the feeding tension for the sheet of material to the encaser 60 (see FIG. 3). The tension control unit 74, for example, can use weight balancing using a plurality of upper and lower rollers through which the sheet of material is threaded as illustrated.

As shown in FIGS. 3 and 11–14, the pad sheet debulking and conveying. means 75 debulks the sheet 95 of a plurality of products or shock absorbing pads 100 from a first bulk size to second bulk size as the pads travel in a predetermined path. The pad sheet debulking and conveying means 75 is preferably provided by a pair of spaced-apart conveyors 76, 77 positioned in non-parallel planes (see FIG. 11) with respect to each other so that a distance between the spaced-apart conveyors 76, 77 is greater at a first end (see FIG. 12) which receives the sheet 95 of the plurality of core pads 90 and encasing sheets 92, 94 than at a second end (see FIG. 13) which outputs the sheet 95 of the plurality of shock absorbing pads 100 and so that the pair of conveyors 76, 77 converge toward each other at the second end to thereby debulk the sheet 95 of the plurality of shock absorbing pads 100 as the sheet 95 conveyingly travels between the conveyors 76, 77 and between the first and second ends thereof along the predetermined path P. As understood by those skilled in the art, the use of the term sheet 95 herein relates to uniform and non-uniform connections of products which also preferably includes a web or chain of products.

As shown in FIG. 3, a mounting frame 78 has the pair of spaced-apart conveyors 76, 77 mounted thereon. The pair of spaced-apart conveyors 76, 77 preferably include a lower belt conveyor 76 positioned to underlie the plurality of core pads 90 when traveling along the predetermined path and an upper belt conveyor 77 positioned to overlie the plurality of core pads 90 and the lower conveyor 76. The lower conveyor 76 preferably extends in a horizontal plane substantially parallel to the plane of a support surface, e.g., a floor such as a manufacturing floor, supporting the mounting frame 78, and the upper conveyor 77 is preferably positioned in a plane transverse to the horizontal plane of the lower conveyor 76, e.g., at a predetermined angle therefrom. The debulking conveyor 75 also includes conveyor position locking and releasing means 79, e.g., provided by a plurality of linking arms and a hydraulic or pneumatic cylinder, connected to the mounting frame 78 and positioned to lock the upper conveyor 77 into a locked position when the sheet 95 of the plurality of shock absorbing pads 100 travel between the upper and lower conveyors 76, 77 and to release the upper conveyor 77 for movement from the locked position when the sheet 95 of the plurality of shock absorbing pads 100 are not traveling between the upper and lower conveyors 76, 77, e.g., when drive motors associated therewith are stopped, to thereby provide a product clearing path for maintenance related to the apparatus 30.

FIGS. 3 and 14–20 show a pad separator 110 of an apparatus 30 of the present invention. The pad separator 110, for example, can advantageously be provided by a roller 111 having a roller body 112 which includes first and second ends 113, 114 and an outer surface 115 which extends substantially circumferentially around outer peripheries of the roller body 112 between the first and second ends 113, 114. At least one blade 116, e.g., a cutting or knife blade, and is preferably a plurality of blades 116, is preferably mounted to the roller 111 so that the plane of the lateral extent of the blade 116 is generally perpendicular to the outer surface 115 of the roller 111 and the entire lengthwise extent of the blade 116 is in a position non-perpendicular to respective planes of the first and second ends 113, 114 of the roller body 112 so as to be skewed between the first and second ends 113, 114 thereof and whereby the combination of the blade 116 and roller 111 define a rotating knife which during rotation thereof cuttingly separates a sheet 95 of shock absorbing pads 100 into a plurality of individual products. A drive 117, drive link belt or chain, and drive motor 135, is preferably connected to the roller 111 for rotationally driving the rotating knife and the controller 130 is preferably connected to the drive 117 for controlling the rotational speed of the rotating knife. A lower nip or support roller 119 is also positioned to support and/or provide a nip for the cutting of the blades 116. The construction of the rotating knife as illustrate and described is of particular advantage when used in conjunction with a sheet 95 of products traveling at a selected speed. The construction as described allows the rotary knife blades 116 to cut a substantially straight line to form edges of the products (See FIGS. 15–20). Otherwise, if the blade 116 where substantially straight between the ends of the roller 111, instead of skewed, the cut would be skewed thereby causing misalignments and various other problems associated therewith.

As illustrated in FIGS. 1–20 and as described above herein, the present invention also advantageously provides a method of forming a plurality of shock absorbing pads 100. The preferably includes the steps of forming core material into a plurality of individual core pads 90, encasing the plurality of individual core pads 90 with a selected sheet or sheets 92, 94 of material to thereby form a sheet 95 of a plurality of shock absorbing pads 100, debulking the sheet 95 of the plurality of shock absorbing pads 100, and separating the sheet 95 into a plurality of individual shock absorbing pads 100.

The method can also include supplying particulate core material for forming the plurality of individual core pads 90 and blowing the particulate core material downstream to a plurality of core pad forming frames 52 mounted to outer peripheries of a drum frame 48 s0 that when the drum frame 48 rotates core material is collected on each of the plurality of core pad forming frames 52. The plurality of core pad forming frames 52 preferably each include a screen (see FIGS. 8–10), and the method can further include drawing the core material onto each of the plurality of screens during rotation of the drum frame 48.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. An apparatus for producing a plurality of shock absorbing pads, the apparatus comprising:

a core material metering feeder positioned to meter and feed downstream a substantially large quantity of substantially dry particulate matter defining core material;

a core pad former positioned downstream from said core material feeder for forming the core material into a plurality of pre-separated individual core pads, the core pad former comprising:

a mounting frame, an annular drum frame rotatingly mounted on the mounting frame, and a plurality of core pad forming frames mounted to outer peripheries of the drum frame for forming individual pre-separated core pads as the drum frame rotates and core material fed by the core material feeder is drawn into each of the plurality of core pad forming frames;

a core pad conveyor having a portion overlying the core pad former positioned to receive each of the plurality of individual core pads as each is lifted upwardly off the core pad former by a pressure differential and conveying each of the plurality of individual core pads downstream, the core pad conveyor comprising a screen conveying belt;

a blower positioned upstream from the core material feeder and connected to the core pad feeder to blowingly supply air to the core material feeder to thereby blow the core material to the core pad former;

an air pressure supply in fluid communication with the blower, the core pad former, and the core pad conveyor to create a pressure differential to draw core material into the core pad forming frames and to lift upwardly each of the plurality of individual core pads off the core pad former and hold each against the screen conveying belt of the core pad conveyor for conveying the individual core pads downstream;

a core pad encaser positioned downstream from said core pad former for encasing the plurality of individual core pads with a selected sheet of material to thereby form a sheet of a plurality of shock absorbing pads;

a pad sheet debulking conveyor positioned downstream from said core pad conveyor and adjacent said core pad encaser for debulking the sheet of the plurality of shock absorbing pads and conveying the sheet of the plurality of shock absorbing pads downstream; and a pad separator positioned downstream said pad sheet conveyor for separating the sheet into a plurality of individual shock absorbing pads.

2. An apparatus as defined in claim 1, further comprising:

a grinder positioned upstream from said core material feeder in fluid communication with said blower to grind matter into particulate matter and thereby provide said particulate matter to the blower to be borne by the blowingly supplied air to said core pad former.

3. An apparatus as defined in claim 1, wherein said core pad encaser includes:

a bottom sheet delivery positioned to deliver a sheet of material which forms a bottom sheet underlying the plurality of individual core pads; and a top sheet delivery positioned to deliver a sheet of material which forms a top sheet overlying each of the plurality of individual core pads and abuttingly contacting at least portions of the bottom sheet.

4. An apparatus as defined in claim 1, wherein said pad sheet debulking conveyor includes a pair of spaced-apart conveyors, the pair of spaced-apart conveyors including a lower conveyor positioned to underlie the sheet of the plurality of shock absorbing pads and an upper conveyor positioned to overlie the sheet of the plurality of shock absorbing pads and the lower conveyor, the upper and lower conveyors being positioned in non-parallel planes so that a distance between the spaced-apart conveyors is greater at an end which receives the sheet of the plurality of shock absorbing pads than at an end which outputs the sheet of the plurality of shock absorbing pads to said pad separator.

5. An apparatus as defined in claim 1, further comprising an encasing material feeder positioned to supply encasing material to said core pad encaser so that the supplied material encases each of the plurality of core pads.

6. An apparatus as defined in claim 5, wherein the encasing material includes paper, and wherein said encasing material feeder supplies a sheet of top paper to said core pad encaser and a sheet of bottom paper to said core pad encaser.

7. An apparatus as defined in claim 6, wherein said core pad encaser includes at least a pair of feed rolls for feeding the top and bottom sheets of paper so as to encase the plurality of core pads and an adhesive applier positioned to apply adhesive at least between the top and bottom sheets of paper so that when at least portions of the top and bottom sheets abuttingly contact each other the adhesive sealingly maintains the contact.

8. An apparatus as defined in claim 1, further comprising an output conveyor positioned downstream from said pad separator for conveying each of the plurality of individual shock absorbing pads downstream.

9. An apparatus as defined in claim 1, wherein said pad separator includes at least one blade mounted to a roller to provide a blade and roller combination defining a rotating knife which during rotation thereof cuttingly separates the sheet of the plurality of shock absorbing pads into a plurality of individual shock absorbing pads.

10. An apparatus as defined in claim 9, wherein the at least one blade of the rotating knife is connected to an outer surface of the roller and extends outwardly therefrom, and wherein the entire lengthwise edge of the at least one blade is parallel to the roller's outer surface and is positioned non-perpendicular to planes parallel to the respective ends of the roller so as to be skewed between the parallel planes.

11. An apparatus as defined in claim 10, further comprising a controller for controlling the speed and timing of at least the core pad conveyor, the debulking conveyor, and the rotating knife.

12. An apparatus as defined in claim 1, wherein said core pad encaser includes:

a bottom sheet delivery positioned to deliver a bottom sheet of material underlying each of the plurality of individual core pads;

a top sheet delivery positioned to deliver a top sheet of material overlying each of the plurality of individual core pads and abuttingly contacting at least portions of the bottom sheet; and wherein portions of said pad sheet debulking conveyor enhance the sealing of the top and bottom sheets encasing each of the plurality of individual core pads during debulking of each of the plurality of individual core pads encased therein.

13. An apparatus as defined in claim 1, wherein said core pad encaser is associated with said pad sheet debulking conveyor to operably allow enhanced sealing of the material sheet encasing individual core pads and debulking of each of the plurality of individual core pads encased therein.

14. An apparatus as defined in claim 1, wherein the air pressure supply creates a pressure differential on opposing sides of the core pad forming frames, the pressure differential being of sufficient magnitude to draw core material blown by the blower to the core pad former into the core pad forming frames to form individual core pads.

15. An apparatus as defined in claim 14, wherein the core pad forming frame comprises a plurality of screens mounted to the rotating drug frame, the screens having a plurality of openings formed therein that permit air current to pass readily through the screen while holding dry particulate matter against the screen when a pressure differential exists on opposing sides of the screen.

16. An apparatus as defined in claim 15, wherein the pressure differential on the opposing sides of the core pad forming frames defines a first pressure differential, and wherein the air pressure supply creates a second pressure differential on opposing sides of the screen conveying belt of the core pad conveyor, the second pressure differential being sufficient to lift upwardly an individual core pad off a core pad forming frame screen in which the individual core pad has been formed and hold the individual core pad against the screen conveying belt of the core pad conveyor as the core pad is conveyed downstream by the screen conveying belt.

17. An apparatus for producing a plurality of shock absorbing pads, the apparatus comprising:

a core pad former positioned to form particulate core material into a plurality of pre-separated individual core pads, the core pad former comprising:

a mounting frame, an annular drum frame rotatingly mounted on the mounting frame, and a plurality of core pad forming frames mounted to outer peripheries of the drum frame for forming individual core pads as the drum frame rotates and core material fed by the core material feeder is drawn into each of the plurality of core pad forming frames;

a core pad conveyor having a portion overlying the core pad former positioned to receive each of the plurality of individual core pads as each is lifted upwardly off the core pad former by a pressure differential and conveying each of the plurality of individual core pads downstream;

an air pressure supply in fluid communication with the core pad former to create pressure differentials to draw core material into the core pad forming frames and two lift upwardly each of the plurality of individual core pads off the core pad former to the conveyor;

a core pad encaser positioned downstream from said core pad former for encasing the plurality of individual core pads with a selected sheet of material to thereby form a sheet of a plurality of shock absorbing pads;

pad sheet debulking and conveying means positioned adjacent said core pad encaser for debulking the sheet of the plurality of shock absorbing pads and conveying the sheet of the plurality of shock absorbing pads downstream; and a pad separator positioned downstream said pad sheet conveyor for separating the sheet into a plurality of individual shock absorbing pads.

18. An apparatus as defined in claim 17, further comprising a core material feeder positioned upstream from said core pad former and a blower positioned upstream from said core material feeder to blowingly supply air to the core material to thereby blow the core material to said core pad former.

19. An apparatus as defined in claim 17, wherein said core pad encaser includes a bottom sheet delivery positioned to deliver a sheet of material which forms a bottom sheet underlying the plurality of individual core pads and a top sheet delivery positioned to deliver a sheet of material which forms a top sheet overlying each of the plurality of individual core pads and abuttingly contacting at least portions of the bottom sheet.

20. An apparatus as defined in claim 17, wherein said pad sheet debulking and conveying means includes a pair of spaced-apart conveyors, the pair of spaced-apart conveyors including a lower conveyor positioned to underlie the sheet of the plurality of shock absorbing pads and an upper conveyor positioned to overlie the sheet of the plurality of shock absorbing pads and the lower conveyor, the upper and lower conveyors being positioned in non-parallel planes so that a distance between the spaced-apart conveyors is greater at an end which receives the sheet of the plurality of shock absorbing pads than at an end which outputs the sheet of the plurality of shock absorbing pads to said pad separator to thereby debulk the sheet of the plurality of shock absorbing pads as the sheet conveyingly travels between the ends thereof.

21. An apparatus as defined in claim 20, further comprising an encasing material feeder positioned to supply encasing material to said core pad encaser so that the supplied material encases each of the plurality of core pads.

22. An apparatus as defined in claim 21, wherein the encasing material includes paper, and wherein said encasing material feeder supplies a sheet of top paper to said core pad encaser and a sheet of bottom paper to said core pad encaser.

23. An apparatus as defined in claim 22, wherein said core pad encaser includes at least a pair of feed rolls for feeding the top and bottom sheets of paper so as to encase the plurality of core pads and an adhesive applier positioned to apply adhesive at least between the top and bottom sheets of paper so that when at least portions of the top and bottom sheets abuttingly contact each other the adhesive sealingly maintains the contact.

24. An apparatus as defined in claim 23, further comprising an output conveyor positioned downstream from said pad separator for conveying each of the plurality of individual shock absorbing pads downstream.

25. An apparatus as defined in claim 17, wherein said pad separator includes at least one blade mounted to a roller to provide a blade and roller combination defining a rotating knife which during rotation thereof cuttingly separates the sheet of the plurality of shock absorbing pads into a plurality of individual shock absorbing pads.

26. An apparatus as defined in claim 25, wherein the at least one blade of the rotating knife is connected to an outer surface of the roller and extends outwardly therefrom, and wherein the entire lengthwise edge of the at least one blade is parallel to the roller's outer surface and is positioned non-perpendicular to planes parallel to the respective ends of the roller so as to be skewed between the parallel planes.

27. An apparatus as defined in claim 17, further comprising a controller for controlling the speed and timing of at least the debulking and conveying means and the pad separator.

28. An apparatus as defined in claim 18, the apparatus further comprising a core pad conveyor positioned adjacent the core pad former, the core pad conveyer comprising a screen conveying belt positioned to receive each of the plurality of individual core pads as each is removed off the core pad former by a pressure differential, the screen conveying belt being positioned to convey the individual core pads downstream.

29. An apparatus as defined in claim 28, wherein the air pressure supply creates a pressure differential on opposing sides of the screen conveying belt of the core pad conveyor, the pressure differential being sufficient to remove an individual core pad off the core pad former and hold the individual core pad against the screen conveying belt as the core pad is conveyed downstream by the screen conveying belt.

* * * * *

UNITED STATES PATENT AND TRADEMARK OFFICE

CERTIFICATE OF CORRECTION

PATENT NO. : 6,311,458 B2
DATED : November 6, 2001
INVENTOR(S) : Tharpe, Jr.

It is certified that error appears in the above-identified patent and that said Letters Patent is hereby corrected as shown below:

Column1,
Line 19, please delete “damaged” and insert -- damage -- therefor.

Column 2,
Line 22, please delete “when” and insert -- which -- therefor.
Line 28, between “blade” and “is”, please delete “of the”.

Column 3,
Line 1, between “view” and “a”, please insert -- of --.

Column 4,
Lines 42-43, please delete “i a loading container” and insert -- a plurality of loading containers -- therefor.

Column 5,
Line 36, after “50”, please insert -- are pressure lifted to the screen conveying belt 57”.

Column 6,
Line 2, between “preferably” and “upper”, please insert -- includes --.
Line 18, between “conveying” and “means”, please delete “.”.
Line 20, between “to” and “second”, please insert -- a --.

Column 7,
Line 28, please delete “where” and insert -- were -- therefor.
Line 35, between “The” and “preferably”, please insert -- method --.
Line 47, please delete “s0” and insert -- so -- therefor.

UNITED STATES PATENT AND TRADEMARK OFFICE

CERTIFICATE OF CORRECTION

PATENT NO. : 6,311,458 B2
DATED : November 6, 2001
INVENTOR(S) : Tharpe, Jr.

It is certified that error appears in the above-identified patent and that said Letters Patent is hereby corrected as shown below:

Column 10,
Line 3, please delete “drug” and insert -- drum -- therefor.
Line 40, please delete “two” and insert -- to -- therefor.

Signed and Sealed this

Twenty-fifth Day of June, 2002

*Attest:*

*Attesting Officer*

JAMES E. ROGAN
*Director of the United States Patent and Trademark Office*